US010044153B1

(12) United States Patent
Huang

(10) Patent No.: US 10,044,153 B1
(45) Date of Patent: Aug. 7, 2018

(54) COAXIAL ELECTRICAL CONNECTOR HAVING A SHELL WITH A CAP WITH A CONICAL WALL SURFACE

(71) Applicant: Din Yi Industrial Co., Ltd., New Taipei (TW)

(72) Inventor: Ching-Kun Huang, New Taipei (TW)

(73) Assignee: Din Yi Industrial Co., Ltd., New Taipei (TW)

( * ) Notice: Subject to any disclaimer, the term of this patent is extended or adjusted under 35 U.S.C. 154(b) by 0 days.

(21) Appl. No.: 15/821,881

(22) Filed: Nov. 24, 2017

(51) Int. Cl.
*H01R 9/05* (2006.01)
*H01R 24/38* (2011.01)
*H01R 13/623* (2006.01)

(52) U.S. Cl.
CPC ..... *H01R 24/38* (2013.01); *H01R 13/623* (2013.01)

(58) Field of Classification Search
CPC ..... H01R 9/05; H01R 9/0518; H01R 13/59; H01R 24/38
USPC ..... 439/578, 581, 584
See application file for complete search history.

(56) References Cited

U.S. PATENT DOCUMENTS 5,667,409 A * 9/1997 Wong ..... H01R 9/0503 439/578
6,071,144 A * 6/2000 Tang ..... H01R 13/52 439/426
6,786,757 B2 * 9/2004 Pocrass ..... H01R 9/0524 439/418
7,896,695 B1 * 3/2011 Huang ..... H01R 13/111 439/578
2006/0246774 A1 * 11/2006 Buck ..... H01R 9/0521 439/578
2012/0244744 A1 * 9/2012 Huang ..... H01R 13/521 439/519
2012/0252269 A1 * 10/2012 Huang ..... H01R 13/502 439/586

* cited by examiner

*Primary Examiner* — Chandrika Prasad

(57) ABSTRACT

An electrical connector for coaxial conductor includes a shell, a first cap, a second cap, a conducting member and a conductor. The first cap and the second cap are in contact with each other and simultaneously located in the shell. The conducting member has an end pressing against the first cap and another end against the second cap. The conductor is extended through the second cap, such that a section of the conductor that is projected into the second cap is connected to the conducting member. With the shell, the first cap, the second cap, the conducting member and the conductor assembled in the above manner, the number of parts for the electrical connector is decreased to enable a reduced overall volume of the electrical connector.

7 Claims, 6 Drawing Sheets

COAXIAL ELECTRICAL CONNECTOR HAVING A SHELL WITH A CAP WITH A CONICAL WALL SURFACE

FIELD OF THE INVENTION

The present invention relates to an electrical connector, and more particularly to an electrical connector for coaxial conductor that can be connected to a transmission connector on an electrical or an electronic device.

BACKGROUND OF THE INVENTION

Generally, the cable television in a house is connected to a coaxial cable that transmits signals. The coaxial cable has the advantages of large bandwidth, not easily subjected to noise interference, etc. Therefore, the coaxial cable is widely used for transmitting family TV signals. Also, due to the above advantages, the coaxial cable is also widely used as a transmission medium for wideband networks.

FIGS. 1 and 2 show a conventional electrical connecting terminal 1 that is common in the market. The conventional electrical connecting terminal 1 includes a protective shell 10 and a pin-shaped conductor 11 axially centered in the protective shell 10. The pin-shaped conductor 11 has an end section partially projected from the protective shell 10. Another opposite end of the pin-shaped conductor 11 is connected to a resilient member 12 disposed in the protective shell 10.

As shown, the pin-shaped conductor 11 is extended through a first washer 13, a second washer 14 and a third washer 15 to be located in the protective shell 10. The resilient member 12 is fitted in a first cap 16, which is arranged to one end of the first washer 13 opposite to the second and third washers 14, 15. With the first cap 16 and a second cap 17 covering on around the first cap 16, the resilient member 12 is located in the protective shell 10. To assemble the protective shell 10, the pin-shaped conductor 11, the resilient member 12, the first, second and third washers 13, 14, 15, and the first and second cap 16, 17 together to form the electrical connecting terminal 1, first connect the pin-shaped conductor 11 to the resilient member 12, and then sequentially fit the first, the second and the third washer 13, 14, 15 around the pin-shaped conductor 11. Thereafter, fit the first cap 16 around the resilient member 12 and cover the second cap 17 on around the first cap 16. Finally, the preliminarily assembled pin-shaped conductor 11, resilient member 12, first washer 13, second washer 14, third washer 15, first cap 16 and second cap 17 are together extended into the protective shell 10 to complete the conventional electrical connecting terminal 1. It can be found the conventional electrical connecting terminal 1 includes a large number of parts and accordingly, has a relatively big overall volume.

SUMMARY OF THE INVENTION

A primary object of the present invention is to provide an electrical connector for coaxial conductor, which is assembled from less number of parts having improved structural design and can therefore have a reduced overall volume.

Another object of the present invention is to provide an electrical connector for coaxial conductor, which allows a cable to extend there into without damaging a conducting member in the electrical connector, so that the electrical connector can have a prolonged service life.

To achieve the above and other objects, the electrical connector for coaxial conductor according to a preferred embodiment of the present invention includes a shell, a first cap, a second cap, a conductor and a conducting member. The shell internally defines a receiving passage and has an annular shoulder portion formed in around the receiving passage to divide the receiving passage into a first assembling space and a second assembling space. Further, the shell is formed in around two opposite ends of the receiving passage with a first stop portion and a second stop portion.

The first cap is fitted in the first assembling space and includes a disc-shaped base portion and a tubular base portion formed on the disc-shaped base portion. The disc-shaped base portion is formed with a contact surface, which is flush with the shoulder portion. The tubular base portion includes an abutting surface. And, the contact surface and the abutting surface of the first cap respectively have a normal extending in parallel with the conductor. An axially outer side of the disc-shaped base portion of the first cap opposite to the contact surface is pressed against the first stop portion of the shell. In the preferred embodiment, the tubular base portion of the first cap internally defines an abutting space, and the disc-shaped base portion of the first cap is formed with an axially extended contact space, which has a diameter smaller than the abutting space. The abutting surface is formed between the abutting space and the contact space.

The second cap is fitted in the second assembling space and includes a base portion located farther away from the first cap. The base portion of the second cap is formed with an axially extended insertion space. The base portion is partially extended toward the disc-shaped base portion to form a hollow tubular portion with a wall surface formed between the base portion and the tubular portion, and the tubular portion has a free end in contact with the shoulder portion of the shell and the contact surface of the disc-shaped base portion. In the preferred embodiment, the tubular base portion of the first cap is located in the tubular portion of the second cap; and the wall surface formed between the base portion and the tubular portion of the second cap is axially inward tapered to form a conic wall surface. Further, the base portion of the second cap is pressed against the second stop portion.

The conductor is extended through the insertion space of the base portion of the second cap with a length of the conductor projected from the base portion into the tubular portion to form a connecting section. The conductor has a stop section dimensioned larger than the insertion space, such that the stop section is press-fitted in the insertion space when the conductor is extended through the insertion space. The conducting member is disposed in the tubular portion of the second cap. An end of the conducting member is a clamping section for clamping to the connecting section of the conductor, and another opposite end of the conducting member is an engaging section. The clamping section is in contact with the conic wall surface on the base portion of the second cap, and the engaging section is in contact with the tubular base portion of the first cap. In the preferred embodiment, the conic wall surface is in line-to-line contact with the clamping section of the conducting member, and the engaging section is located in the abutting space of the tubular base portion of the first cap and is abutted on the abutting surface of the tubular base portion. Further, the engaging section of the conducting member has an outer diameter the same as an inner diameter of the abutting space of the tubular base portion of the first cap.

The electrical connector of the present invention is characterized in that the shell, the first cap, the second cap, the conducting member and the conductor are so configured that they can be assembled to form the electrical connector without using a number of other parts or accessories, and the completed electrical connector can have an effectively reduced overall volume.

Further, since the first and the second cap are in contact with each other, there is not any clearance left between them. Therefore, the cable extended into the receiving passage of the shell would not cause shifting of the first cap when the cable is extended into the receiving space of the second cap. In this manner, it is able to effectively protect the conducting member against breaking or damage and accordingly, to prolong the service life of the electrical connector for coaxial conductor according to the present invention.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
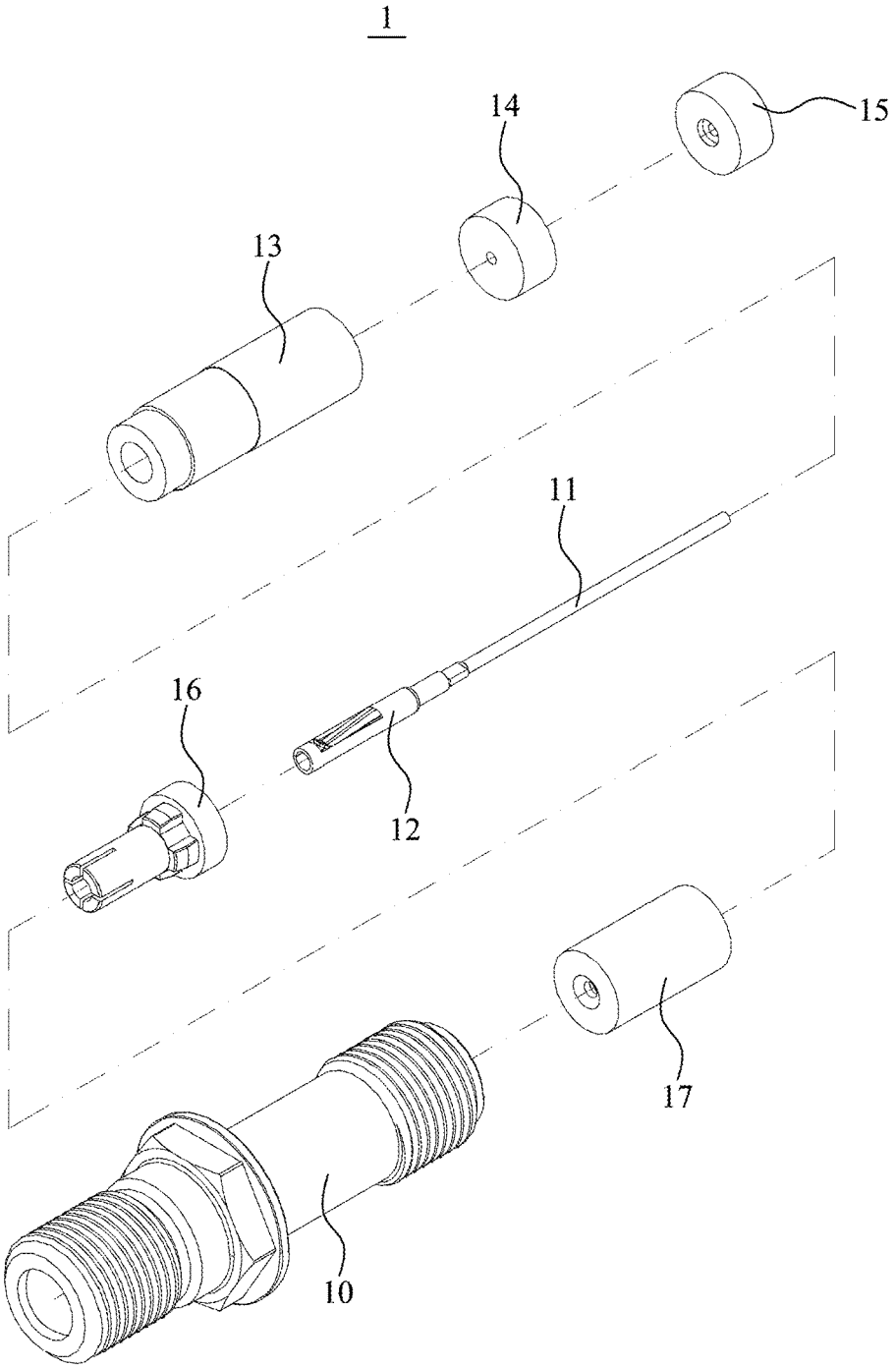
FIG. 1 (Prior Art)
FIG. 1 is an exploded perspective view of a conventional electrical connecting terminal.
Figure 2:
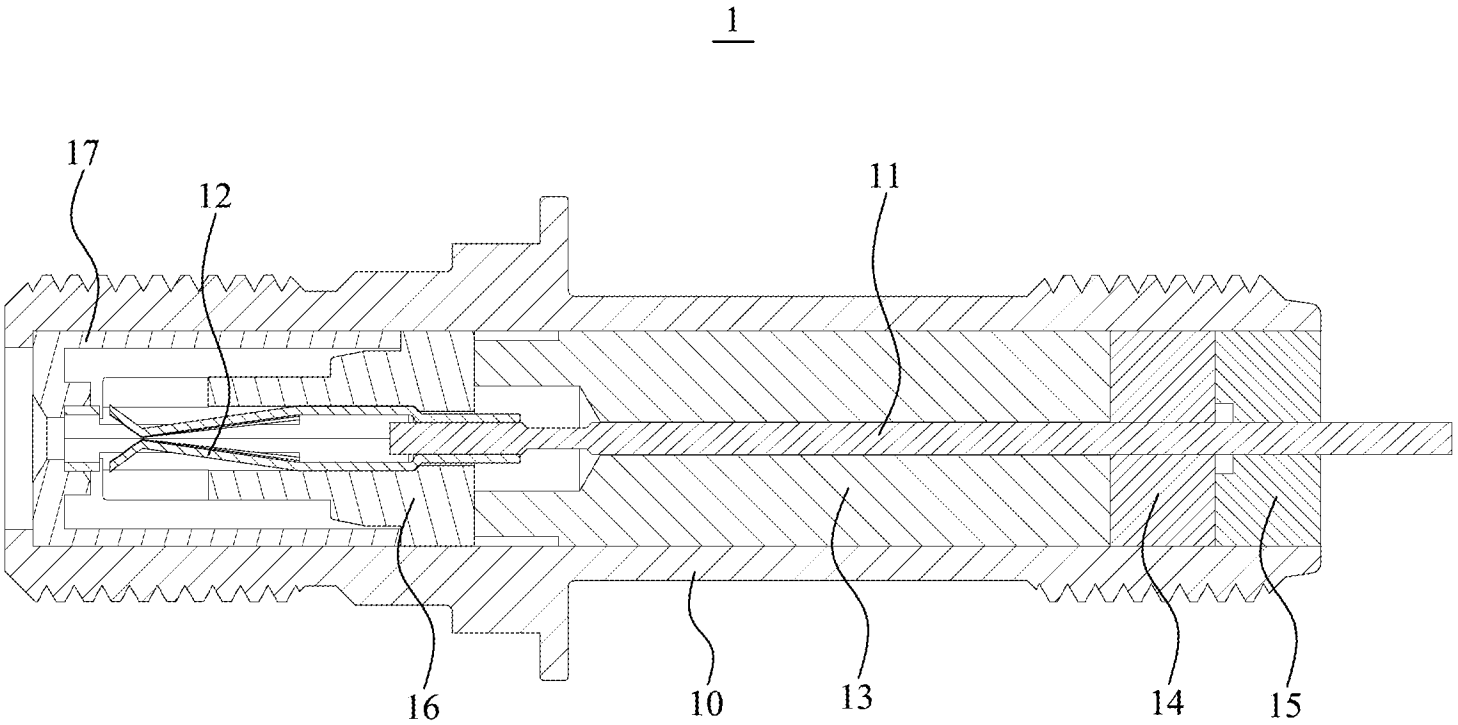
FIG. 2 (Prior Art)
FIG. 2 is an assembled sectional side view of the conventional electrical connecting terminal of FIG. 1.
Figure 3:
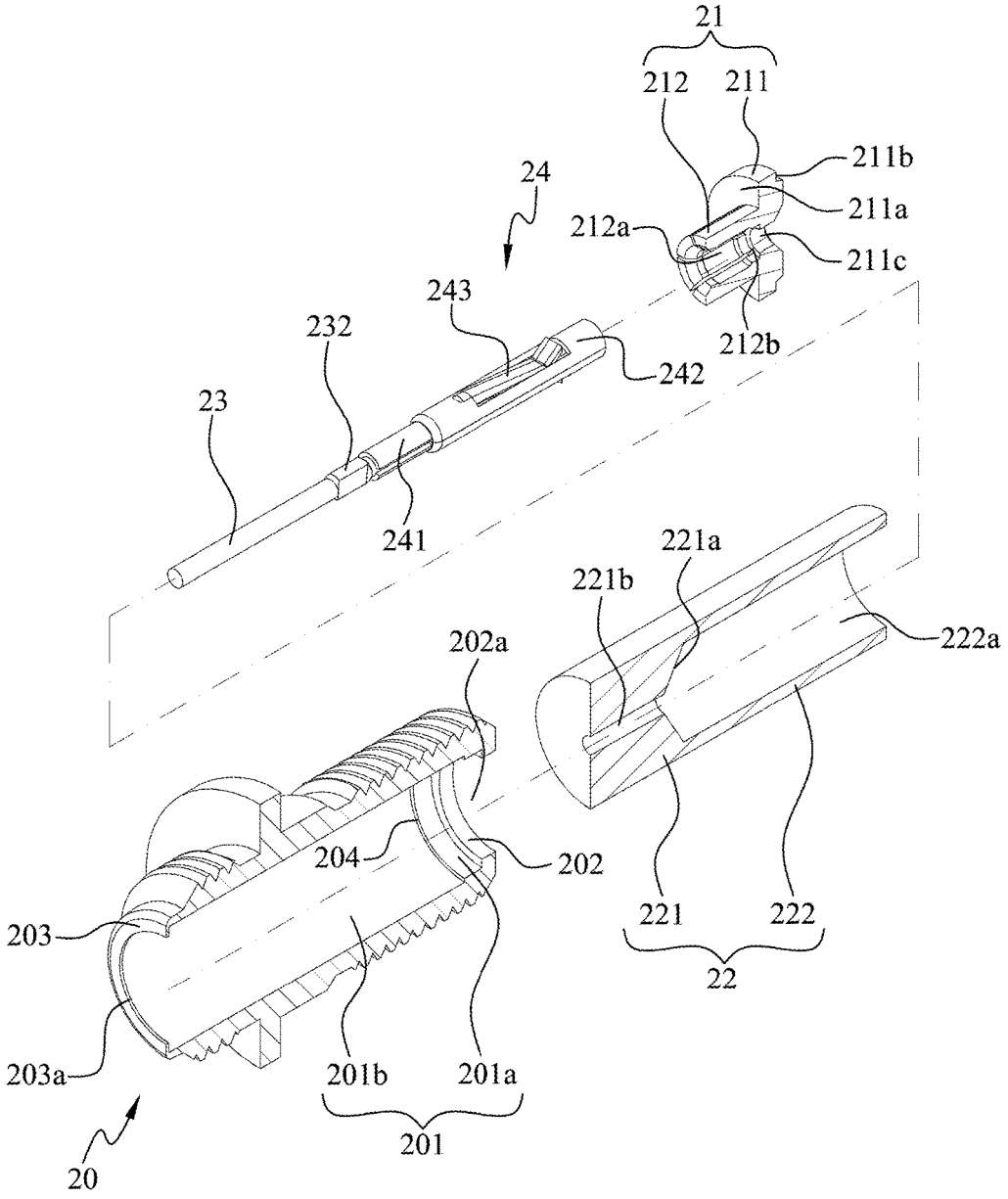
FIG. 3 is an exploded cutaway view of an electrical connector for coaxial conductor according to a preferred embodiment of the present invention.
Figure 4:
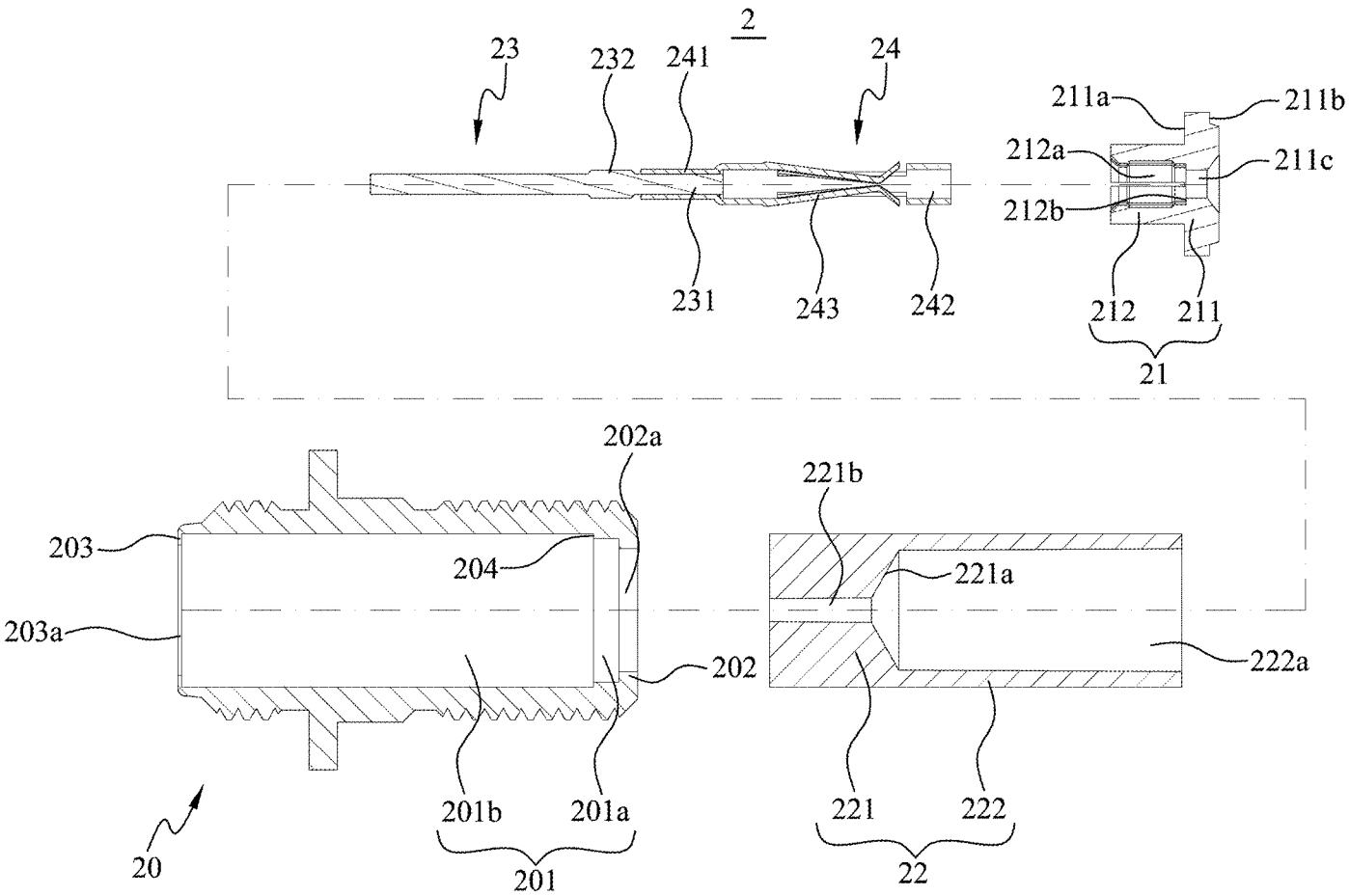
FIG. 4 is an exploded sectional side view of the electrical connector for coaxial conductor according to the preferred embodiment of the present invention shown in FIG. 3.
Figure 5:
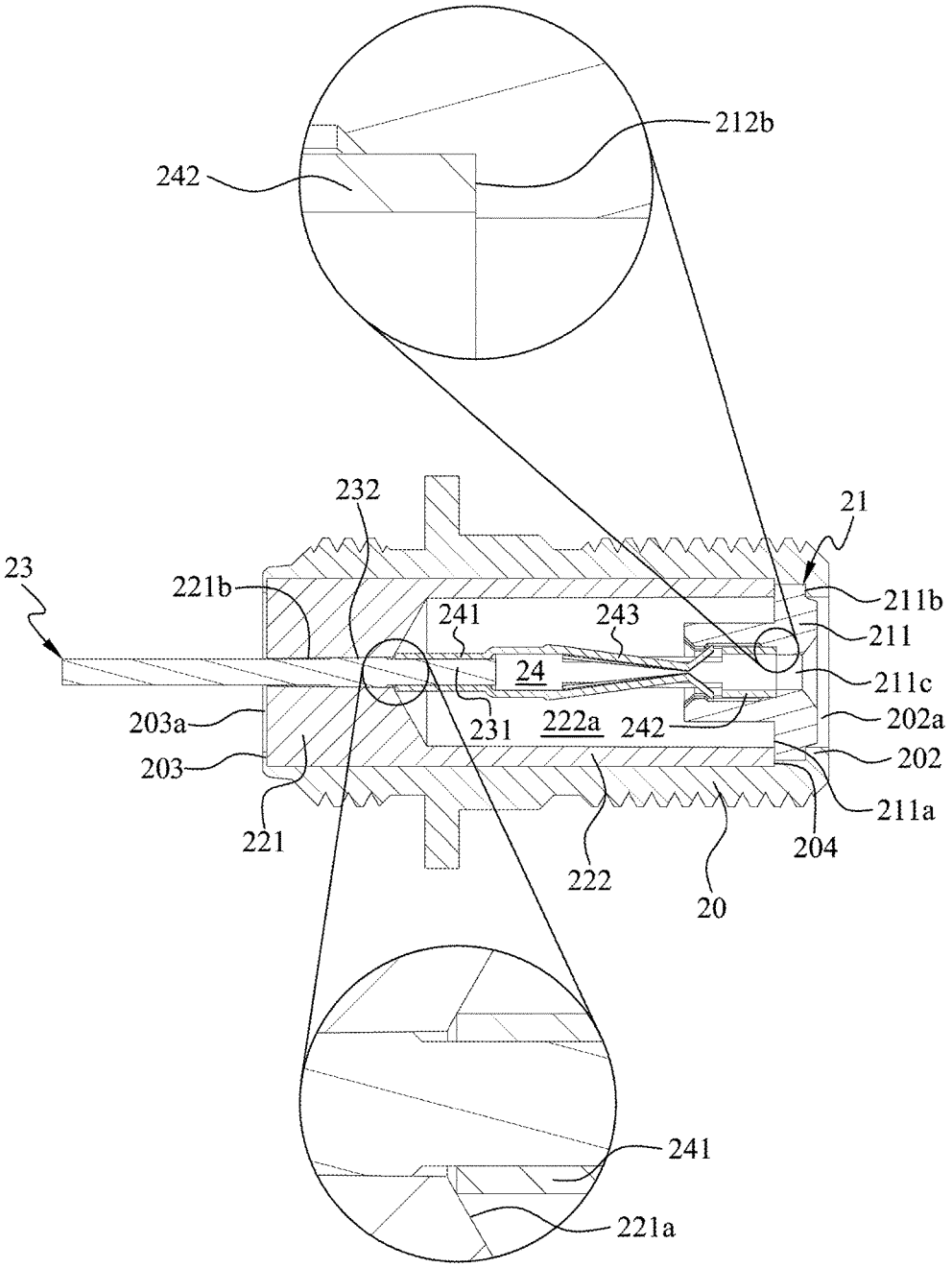
FIG. 5 is an assembled sectional side view of the electrical connector for coaxial conductor according to the preferred embodiment of the present invention shown in FIG. 3.

Please refer to FIGS. 3, 4 and 5, in which an electrical connector for coaxial conductor according to a preferred embodiment of the present invention is shown. For the purpose of conciseness and clarity, the present invention is also briefly referred to as the electrical connector and denoted by reference numeral 2. As shown, the electrical connector 2 includes a shell 20, a first cap 21, a second cap 22, a conductor 23 and a hollow conducting member 24. The shell 20 is made of an insulation material, and internally defines a substantially cylindrical receiving passage 201. In around an end of the receiving passage 201, there is formed an annular first stop portion 202; and in around the other end of the receiving passage 201 opposite to the first stop portion 202, there is formed an annular second stop portion 203. A part of the receiving passage 201 located adjacent to the first stop portion 202 is a cylindrical first assembling space 201*a*, and the other part of the receiving passage 201 located adjacent to the second stop portion 203 is a second assembling space 201*b*, which is diametrically larger than the first assembling space 201*a*.

As shown, an annular shoulder portion 204 is formed between the first assembling space 201*a* and the second assembling space 201*b*. The shoulder portion 204 is facing toward the second stop portion 203; and the normal of the shoulder portion 204 and of the second stop portion 203 are parallel in direction. The first stop portion 202 defines a first opening 202*a* that communicates with the first assembling space 201*a*; and the second stop portion 203 defines a second opening 203*a* that communicates with the second assembling space 201*b*.

The second cap 22 is located in the second assembling space 201*b* of the receiving passage 201, and includes a base portion 221 located closer to the second stop portion 203 and a tubular portion 222 located farther away from the second stop portion 203. The base portion 221 has an end pressed against the second stop portion 203. The other end of the base portion 221 has a peripheral portion that extends toward the shoulder portion 204 to form the tubular portion 222, and a central portion that is axially inward tapered to form a substantially conic wall surface 221*a*. The conic wall surface 221*a* has a central bottom that forms a bore axially extending through the base portion 221 to provide an insertion space 221*b* in the base portion 221. The tubular portion 222 internally defines a receiving space 222*a*, which communicates with the insertion space 221*b*, and an end of the tubular portion 222 farther away from the base portion 221 is pressed against the shoulder portion 204. As shown, the insertion space 221*b* and the receiving space 222*a* respectively have a cylindrical configuration, while the insertion space 221*b* is diametrically smaller than the receiving space 222*a*.

The first cap 21 includes a disc-shaped base portion 211 fitted in the first assembling space 201*a*. A peripheral portion on an axially inner side of the disc-shaped base portion 211 forms an annular first contact surface 211*a*, which is flush with the shoulder portion 204. Therefore, the shoulder portion 204 and the first contact surface 211*a* are simultaneously in contact with the tubular portion 222. An axially outer side of the disc-shaped base portion 211 is formed around a peripheral area with a second contact surface 211*b*, which is pressed against the first stop portion 202. A central portion of the axially inner side of the disc-shaped base portion 211 forms a tubular base portion 212. The tubular base portion 212 internally defines a substantially cylindrical abutting space 212*a* and axially extends from the first contact surface 211*a* toward the base portion 221 of the second cap 22 to be located in the receiving space 222*a* of the second cap 22. The disc-shaped base portion 211 is provided with a centered through bore that extends from the axially inner side to the axially outer side of the disc-shaped base portion 211 and functions as a contact space 211*c* communicable with the abutting space 212*a*. The contact space 211*c* is also cylindrical in shape and is diametrically smaller than the abutting space 212*a*, such that an abutting surface 212*b* is formed between the abutting space 212*a* and the contact space 211*c*. The directions of the normal of the abutting surface 212*b* and of the conductor 23 inserted in the electrical connector 2 are in parallel with each other. In the illustrated preferred embodiment of the present invention, the directions of the normal of the first contact surface 211*a*, of the second contact surfaces 211*b* and of the abutting surface 212*b* are in parallel with one another.

The conductor 23 is made of a flexible and electrically conducting material. The conductor 23 is extended through the second opening 203*a* of the shell 20 toward the first opening 202*a*, such that the conductor 23 passes through the insertion space 221*b* of the second cap 22 with an end portion of the conductor 23 located in the receiving space 222*a* to form a connecting section 231. A middle portion of the conductor 23 is formed into a stop section 232, which is dimensioned larger than an inner diameter of the insertion space 221*b*. However, since the conductor 23 is flexible, the dimension-enlarged stop section 232 of the conductor 23 can still be forced through the insertion space 221*b* and be press-fitted in the insertion space 221*b*, enabling the conductor 23 to be connected to the second cap 22. Please refer to FIG. 5. The conducting member 24 is disposed in the receiving space 222*a* of the tubular portion 222 of the second cap 22. An end of the conducting member 24 closer to the base portion 221 is formed into a clamping section 241, and the other opposite end of the conducting member 24 closer to the disc-shaped base portion 211 is formed into an engaging section 242. Two flat spring members 243 are disposed in a middle section of the conducting member 24 between the clamping section 241 and the engaging section 242. The clamping section 241 is riveted to the connecting section of the conductor 23, and is in line-to-line contact with the conic wall surface 221*a* of the base portion 221 of the second cap 22. The engaging section 242 has an outer diameter similar to an inner diameter of the abutting space 212*a* in the tubular base portion 212 of the first cap 21 and is riveted to the abutting space 212*a*, enabling the engaging section 242 of the conducting member 24 to abut on the abutting surface 212*b*.

Figure 6:
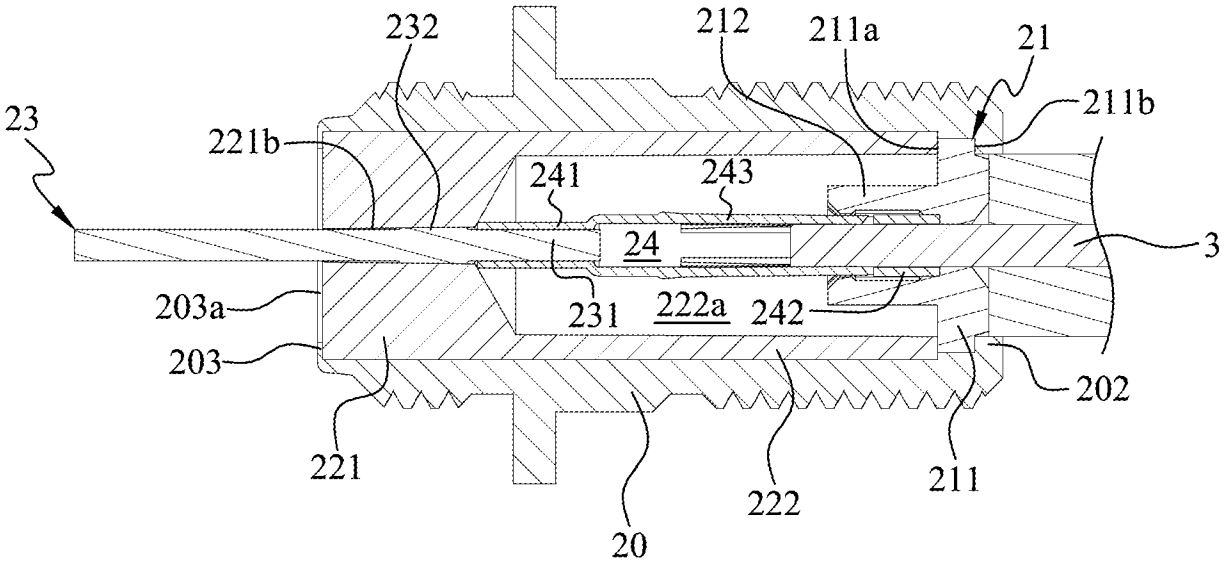
FIG. 6 is an assembled sectional side view of the electrical connector for coaxial conductor according to the preferred embodiment of the present invention shown in FIG. 3 with a cable connected thereto.

Please refer to FIG. 6. To use the electrical connector 2 of the present invention, first extend a cable 3 into the shell 20 from the first opening 202*a* toward the second opening 203*a*, so that the cable 3 sequentially passes through the contact space 211*c* of the disc-shaped base portion 211 and the engaging section 242 of the conducting member 24 to be partially located in the receiving passage 201 of the shell 20. At this point, the two flat spring members 243 will elastically clamp on the cable 3 to prevent the latter from being easily moved out of the shell 20. Further, since the first and the second cap 21, 22 are in contact with each other, there is not any clearance left between the first and the second cap 21, 22. Therefore, the cable 3 extended into the receiving passage 201 of the shell 20 would not cause shifting of the first cap 21 when the cable 3 is extended into the receiving space 222*a* of the second cap 22. In this manner, it is able to effectively protect the conducting member 24 against breaking or damage and accordingly, to prolong the service life of the electrical connector for coaxial conductor according to the present invention.

Please refer to FIG. 5 again. In the present invention, the shell 20, the first cap 21, the second cap 22, the conducting member 24 and the conductor 23 are so configured that they can be assembled to form the electrical connector 2 without using a large number of other parts or accessories, and the completed electrical connector 2 can have an effectively reduced overall volume.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An electrical connector for coaxial conductor, comprising:

a shell internally defining a receiving passage and having an annular shoulder portion formed in around the receiving passage to divide the receiving passage into a first assembling space and a second assembling space, which are located at two axially opposite sides of the shoulder portion;

a first cap being fitted in the first assembling space and including a disc-shaped base portion and a tubular base portion formed on the disc-shaped base portion; and the disc-shaped base portion having a contact surface formed thereon;

a second cap being fitted in the second assembling space and including a base portion located farther away from the first cap; the base portion being partially extended toward the disc-shaped base portion to form a hollow tubular portion with a wall surface formed between the base portion and the tubular portion; and the tubular portion having a free end in contact with the contact surface on the disc-shaped base portion;

a conductor being extended through the base portion of the second cap with a length of the conductor projected from the base portion into the tubular portion to form a connecting section; and a conducting member being disposed in the tubular portion of the second cap; an end of the conducting member being a clamping section for clamping to the connecting section of the conductor, and another opposite end of the conducting member being an engaging section; the clamping section being in contact with the conic wall surface on the base portion of the second cap, and the engaging section being in contact with the tubular base portion of the first cap.

2. The electrical connector for coaxial conductor as claimed in claim 1, wherein the tubular base portion of the first cap is located in the tubular portion of the second cap and includes an abutting surface, on which the engaging section of the conducting member is abutted; and the contact surface and the abutting surface of the first cap respectively have a normal extending in parallel with the conductor.

3. The electrical connector for coaxial conductor as claimed in claim 2, wherein the tubular base portion of the first cap internally defines an abutting space, which has an inner diameter the same as an outer diameter of the engaging section of the conducting member; the disc-shaped base portion of the first cap being formed with an axially extended contact space, which has a diameter smaller than the abutting space; the engaging section of the conducting member being received in the abutting space, and the abutting surface being formed between the abutting space and the contact space.

4. The electrical connector for coaxial conductor as claimed in claim 1, wherein the wall surface on the second cap between the base portion and the tubular portion is axially inward tapered to form a conic wall surface, and the conic wall surface being in line-to-line contact with the clamping section of the conducting member.

5. The electrical connector for coaxial conductor as claimed in claim 1, wherein the shell is formed in around two opposite ends of the receiving passage with a first stop portion and a second stop portion; an axially outer side of the disc-shaped base portion of the first cap opposite to the contact surface being pressed against the first stop portion, and the base portion of the second cap being pressed against the second stop portion.

6. The electrical connector for coaxial conductor as claimed in claim 1, wherein the base portion of the second cap is formed with an axially extended insertion space, through which the conductor is extended into the tubular portion of the second cap; and the conductor having a stop section dimensioned larger than the insertion space, such that the stop section is press-fitted in the insertion space when the conductor is extended through the insertion space.

7. The electrical connector for coaxial conductor as claimed in claim 1, wherein the contact surface of the first cap is flush with the shoulder portion in the receiving passage of the shell, such that the tubular portion of the second cap is simultaneously in contact with the contact surface and the shoulder portion.

* * * * *